US010704771B2

(12) United States Patent
Schubert

(10) Patent No.: US 10,704,771 B2
(45) Date of Patent: Jul. 7, 2020

(54) RECESSED LUMINAIRE MOUNTING ASSEMBLY FOR JUNCTION BOX

(71) Applicant: ABL IP Holding LLC, Atlanta, GA (US)

(72) Inventor: Matthew John Schubert, Roselle, IL (US)

(73) Assignee: ABL IP Holding LLC, Atlanta, GA (US)

( * ) Notice: Subject to any disclaimer, the term of this patent is extended or adjusted under 35 U.S.C. 154(b) by 38 days.

(21) Appl. No.: 16/048,868

(22) Filed: Jul. 30, 2018

(65) Prior Publication Data

US 2020/0032988 A1 Jan. 30, 2020

(51) Int. Cl.
*F21V 21/04* (2006.01)
*F21V 21/088* (2006.01)
*F21S 8/02* (2006.01)

(52) U.S. Cl.
CPC ..... *F21V 21/049* (2013.01); *F21S 8/026* (2013.01); *F21V 21/088* (2013.01)

(58) Field of Classification Search
CPC ..... F21S 8/024; F21S 8/026; F21V 21/04; F21V 21/049; F21V 21/088; Y10S 248/90
See application file for complete search history.

(56) References Cited

U.S. PATENT DOCUMENTS 5,826,970 A 10/1998 Keller et al.
5,836,677 A 11/1998 Connors et al.
6,364,511 B1 4/2002 Cohen
6,474,846 B1 * 11/2002 Kelmelis ..... F21V 17/164 248/231.91
8,097,806 B2 1/2012 Lalancette et al.
8,220,970 B1 7/2012 Khazi et al.
9,892,693 B1 * 2/2018 Kumar ..... F21S 8/026
9,964,266 B2 * 5/2018 Danesh ..... F21V 7/041
2003/0210551 A1 * 11/2003 Sevack ..... F21S 8/02 362/365
2011/0299290 A1 * 12/2011 Mandy ..... F21V 21/04 362/366
2014/0071679 A1 3/2014 Booth
2015/0085500 A1 3/2015 Cooper et al.
2016/0084488 A1 * 3/2016 Wu ..... F21S 8/026 362/364

(Continued)

FOREIGN PATENT DOCUMENTS

JP 2009004324 1/2009

*Primary Examiner* — Anh T Mai
*Assistant Examiner* — Michael Chiang
(74) *Attorney, Agent, or Firm* — Kilpatrick Townsend & Stockton LLP

(57) ABSTRACT

A lighting assembly for illuminating an architectural space includes a mounting bracket with an axial portion, a trim flange ring including an outer surface, and a light fixture including a flange with an external surface such that the lighting assembly has an installed configuration. The axial portion includes an annular cross-section and at least one open end. In the installed configuration, at least a portion of the light fixture is disposed inside the axial portion. In the installed configuration, the trim flange ring is disposed between the mounting bracket and the light fixture. In the installed configuration, the outer surface faces the architectural space such that the outer surface is a concentric ring around the external surface of the flange of the light fixture.

13 Claims, 8 Drawing Sheets

(56) References Cited

U.S. PATENT DOCUMENTS

| | | | | |
|---|---|---|---|---|
| 2016/0312987 | A1 | 10/2016 | Danesh | |
| 2017/0167672 | A1 | 6/2017 | Stauner et al. | |
| 2018/0372284 | A1* | 12/2018 | Danesh | F21S 8/043 |
| 2019/0285259 | A1* | 9/2019 | Tickner | F21V 23/06 |

* cited by examiner

RECESSED LUMINAIRE MOUNTING ASSEMBLY FOR JUNCTION BOX

FIELD OF THE INVENTION

The field of the invention relates to lighting assemblies having recessed lighting fixtures mounted directly in electrical/junction boxes.

BACKGROUND

Electrical boxes for joining conductive wires and providing access thereto are generally mounted in panels (such as walls or ceilings) wherever mounted light fixtures exist. Accordingly, there are a large number of these electrical boxes installed in residential, commercial, and industrial settings. Such electrical boxes are often referred to as "junction boxes," which may, although not necessarily, imply that the box is relevant to multiple sets of conductors in two or more directions. For the present invention, the terms "electrical boxes" and "junction boxes" are used interchangably. Typical recessed down-lights (i.e., lighting fixtures where the light source(s) is recessed above the surface of a wall/ceiling) require mounting hardware, reflectors, frames, cans, and the like mounted above the ceiling plane. Thus, separate holes must be provided in the ceiling to accommodate these fixtures. These recessed down-lights can be relatively large and often require significant skill, time, and planning to install. To power the light source(s), the fixtures are connected to a junction box that is typically located above the ceiling and separate from the fixture. Exposure to the ceiling environment is less than desirable for a variety of reasons. Environmental concerns, such as asbestos contamination and asbestos removal, become an issue when disturbing the ceiling. Moreover, the area above the ceiling collects dirt and dust which can dislodge during fixture installation and thereby increase the time and cost of clean-up after installation. Additionally, exposed electrical wiring is common in such areas, which creates a safety hazard for workers installing the fixtures. A licensed electrician may be required to install the new fixtures based upon common safety codes.

In certain situations, it may be desirable to design recessed lighting fixtures with reduced material and installation requirements that are aesthetically attractive where the light fixture can be secured to a junction box with improved attachment components that simplify and increase reliability of installations of the light fixtures.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a lighting assembly for illuminating an architectural space comprises: a mounting bracket comprising an axial portion, the axial portion comprising an annular cross-section and at least one open end; a trim flange ring comprising an outer surface; a light fixture comprising a flange with an external surface; and an installed configuration, wherein: in the installed configuration, at least a portion of the light fixture is disposed inside the axial portion; in the installed configuration, the trim flange ring is disposed between the mounting bracket and the light fixture; and in the installed configuration, the outer surface faces the architectural space such that the outer surface is a concentric ring around the external surface of the flange of the light fixture.

According to certain embodiments of the present invention, a lighting assembly for illuminating an architectural space comprises: a mounting bracket comprising an axial portion and at least one open end; a light fixture; and an installed configuration, wherein: in the installed configuration, at least a portion of the light fixture is disposed inside the axial portion; and in the installed configuration, at least a majority of the axial portion is disposed inside a junction box.

According to certain embodiments of the present invention, a method of installing a light fixture comprises: providing a mounting bracket comprising an axial portion and at least one open end; and inserting at least a portion of the axial portion into a junction box; attaching the mounting bracket to the junction box; inserting the light fixture into the at least one open end of the mounting bracket, wherein in an installed configuration, at least a portion of the light fixture is disposed inside the junction box.

DETAILED DESCRIPTION

Figure 1:
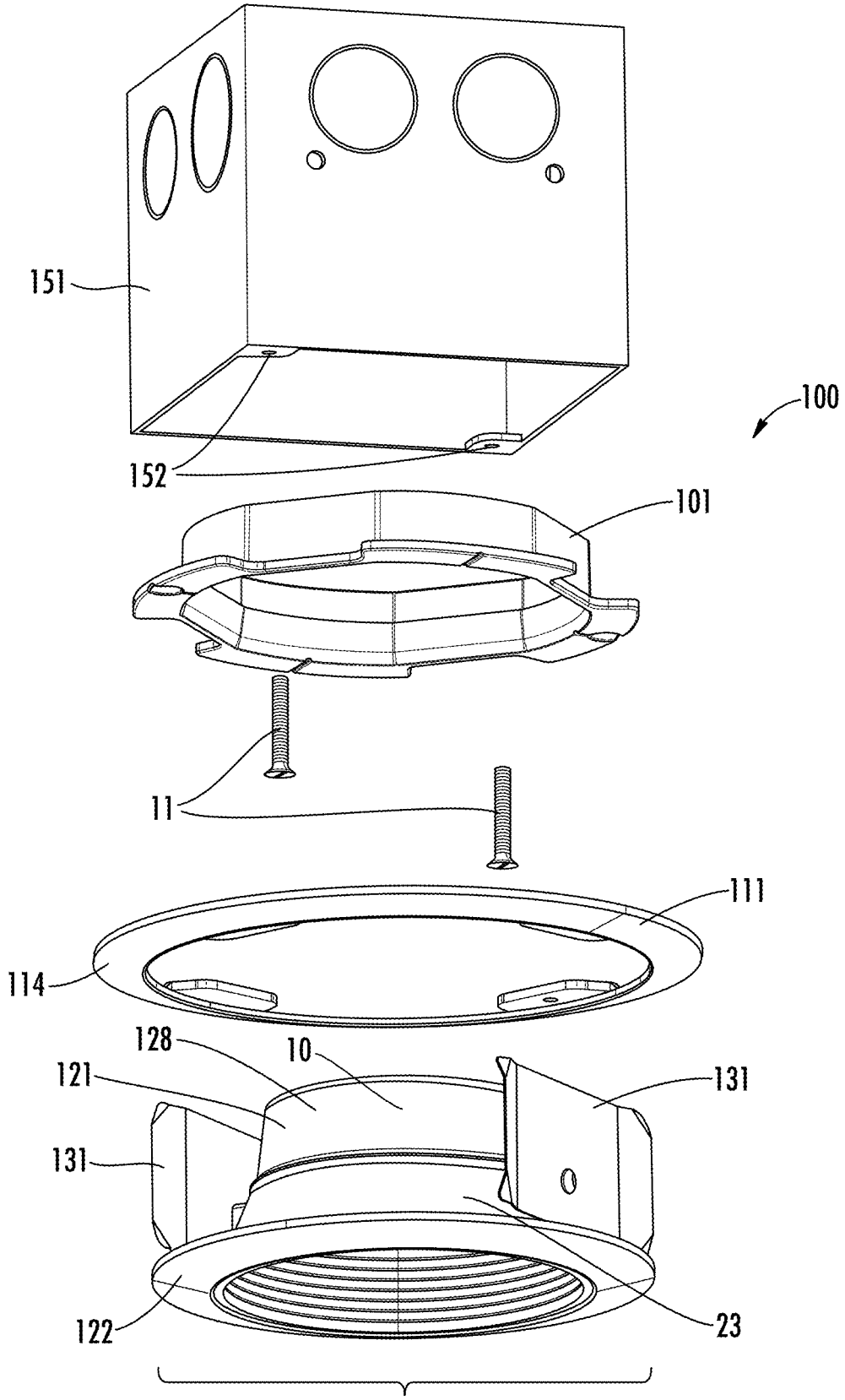
FIG. 1 is an exploded perspective view of a lighting assembly according to an embodiment of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1-6B illustrate embodiments of lighting assemblies 100 that include at least one light fixture 121, a mounting bracket 101, and a trim flange ring 111. The lighting assembly 100 may have an installed configuration where the lighting assembly 100 is directly attached to a junction box 151 (i.e., an electrical box) such that the light fixture 121 is disposed at least partially inside the junction box 151 and is oriented to illuminate an architectural space. The lighting assemblies 100 may be installed and recessed at least partially within a panel, such as a ceiling, wall, or floor panel.

In these embodiments, the light fixture 121 may include a body 23 with a first end 125 disposed at an upper end of the body 23 and a second end 127 disposed at a lower end of the body 23. The light source 10 is internal to the light fixture 121 and disposed adjacent to the first end 125 (see FIGS. 1 and 5A) such that the light source 10 is entirely within the junction box 151 when the lighting assembly 100 is in the installed configuration. Furthermore, the light source 10 is fully recessed behind the panel (e.g., a ceiling, wall, or floor panel). The light fixture body 23 may be formed as a single, monolithic piece or may be formed of two or more components assembled together. At least one sidewall 128 (having an exterior wall 130 and an interior wall 129) extends between the first end 125 and the second end 127 of the light fixture 121. In some embodiments, the exterior wall 130 and interior wall 129 are of the same or similar cross-sectional shape such that the interior shape of the body 23 is substantially the same as the exterior shape of the body 23. However, in other embodiments the interior and exterior shapes of the body 23 may be different.

Figure 2:
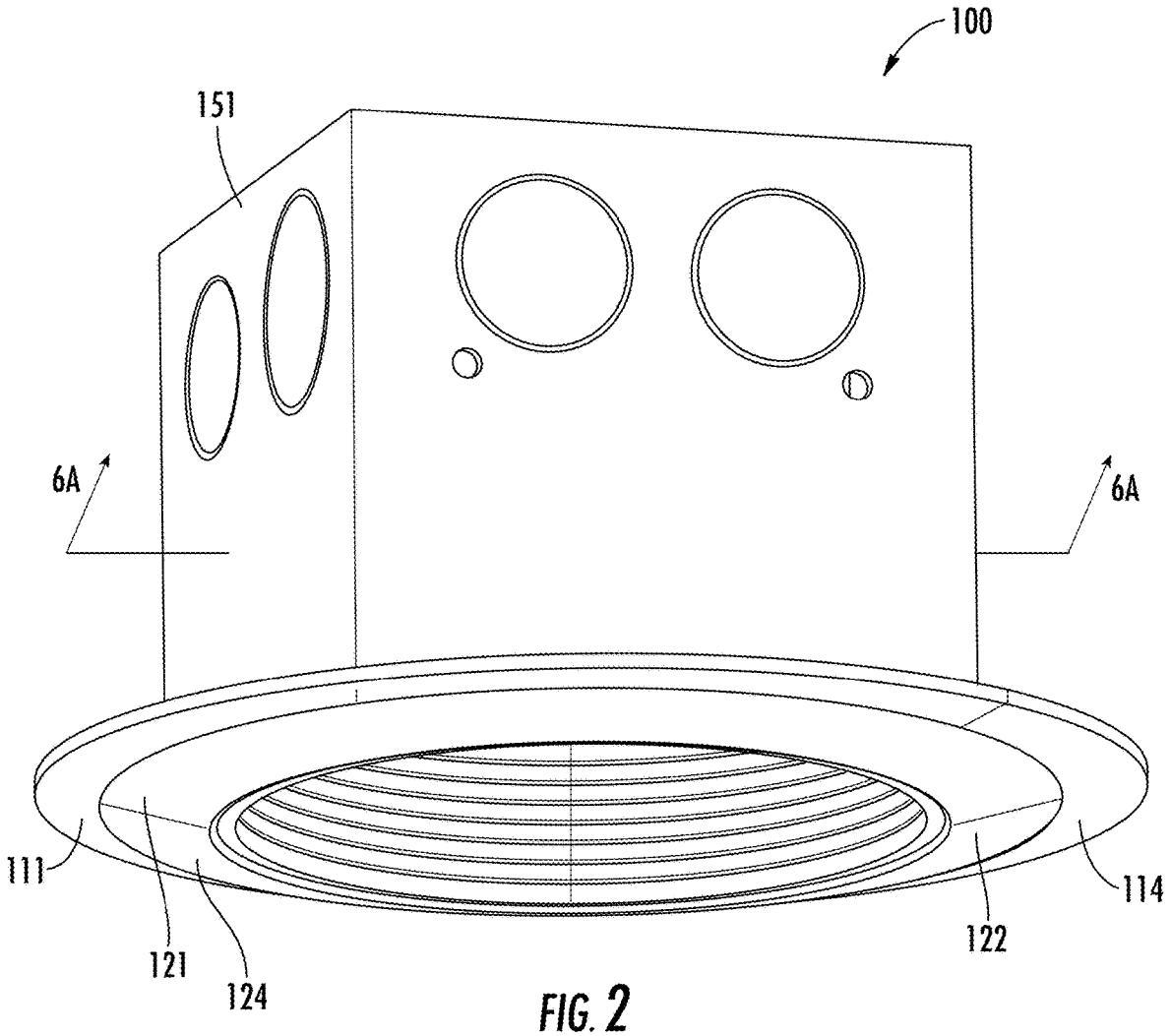
FIG. 2 is an assembled perspective view of the lighting assembly of FIG. 1.
Figure 6A:
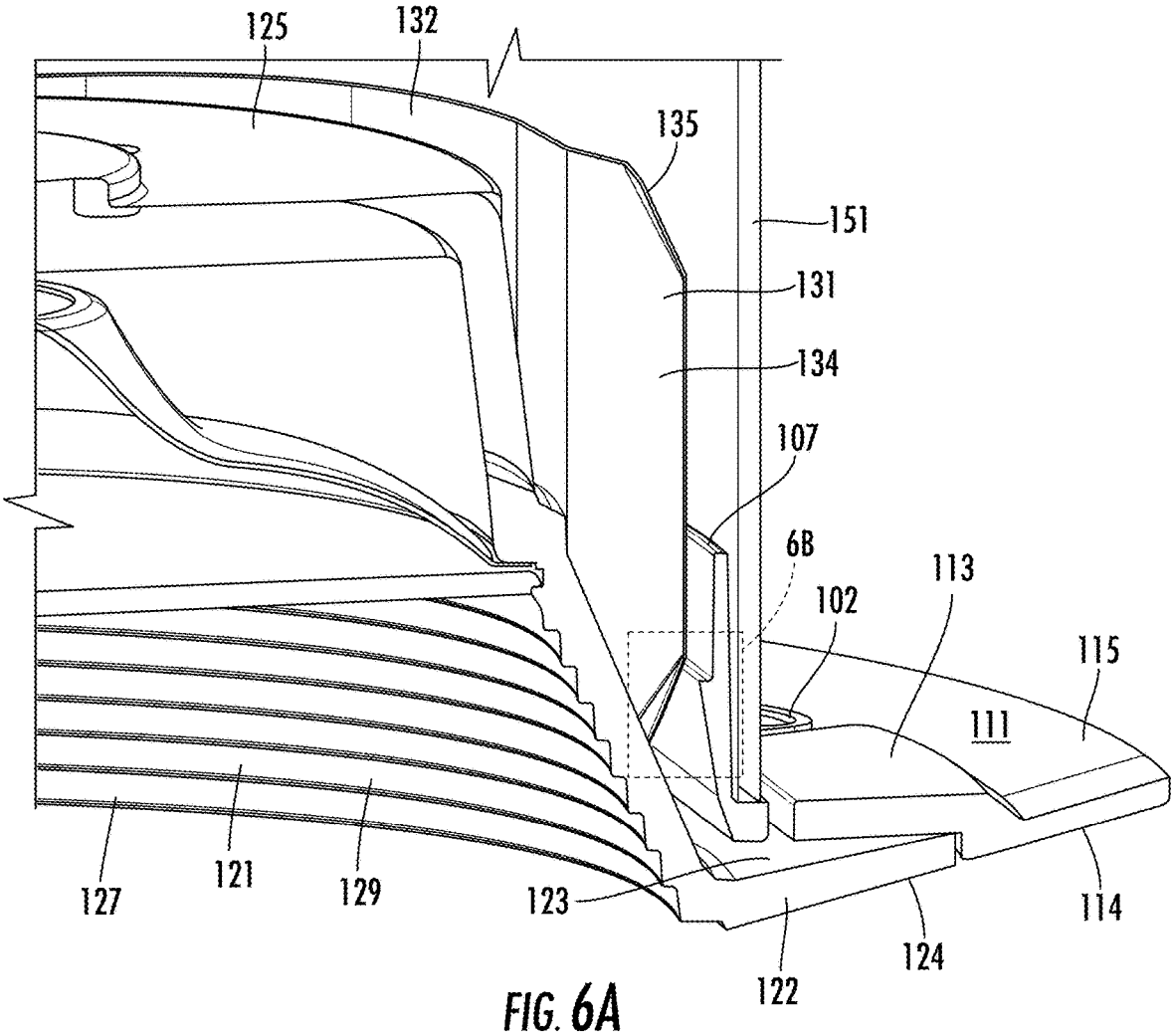
FIG. 6A is a cross-sectional view of the assembled lighting assembly of FIG. 2.

In the illustrated embodiment, the body 23 has a substantially frustoconical shape although the shape may be different. By way only of example, the body 23 may have a shape that is substantially a cylinder, oval, square, rectangle, polygon (e.g., triangle, pentagon, hexagon, etc.), etc. In certain embodiments, the interior wall 129 may include a stepped surface (as shown in FIGS. 1, 2, and 6A) or be texturized to achieve the desired light distribution and output from the light fixture 121. In some embodiments, the interior wall 129 may include a smooth or highly polished reflective surface.

As described above, the light fixture 121 may include a light source 10 arranged therein to emit light from the first end 125 toward the second end 127 such that light exits the second end 127 to illuminate the architectural space. The light source 10 may include one or more light emitting diodes (LED) or any other light source such as fluorescent, incandescent, xenon, halogen, etc.

As shown in FIGS. 1, 2, and 5A-6A, in certain embodiments, the light fixture 121 includes a flange 122 that may be formed as an integral part of the body 23 or as a separate component that is attached to the body 23. The flange 122 may extend outwardly from the body 23 at the second end 127. The flange 122 may include an inner surface 123 and an external surface 124 (see FIGS. 5A-6A). The light fixture 121 may also include at least one spring clip 131 attached to the body 23 for securing the light fixture 121 relative to the other components of the lighting assembly 100, as described in more detail below.

Figure 3A:
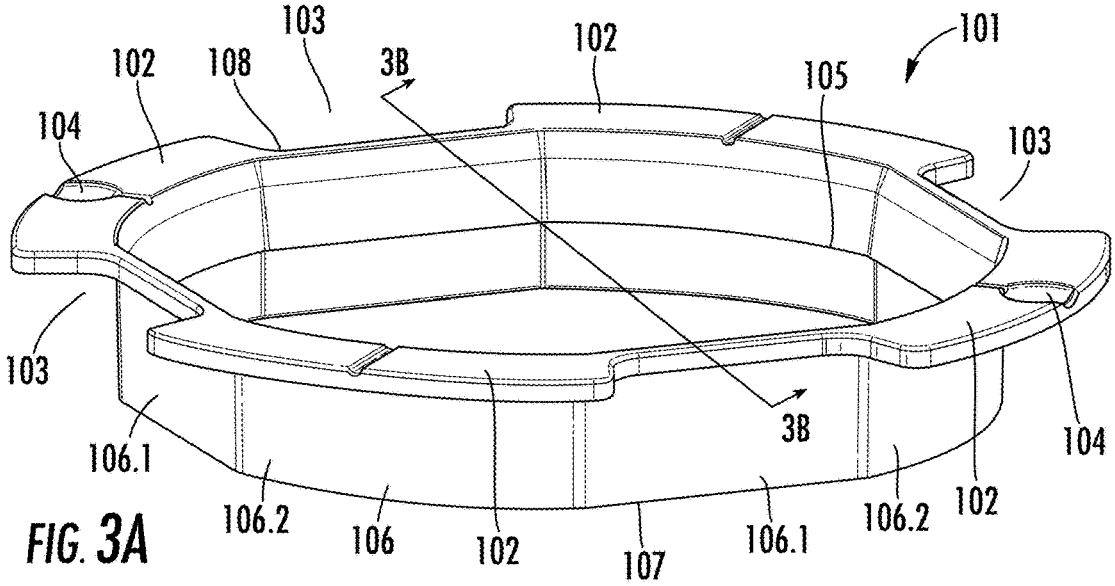
FIG. 3A is a perspective view of a mounting bracket of the lighting assembly of FIG. 1.
Figure 3B:
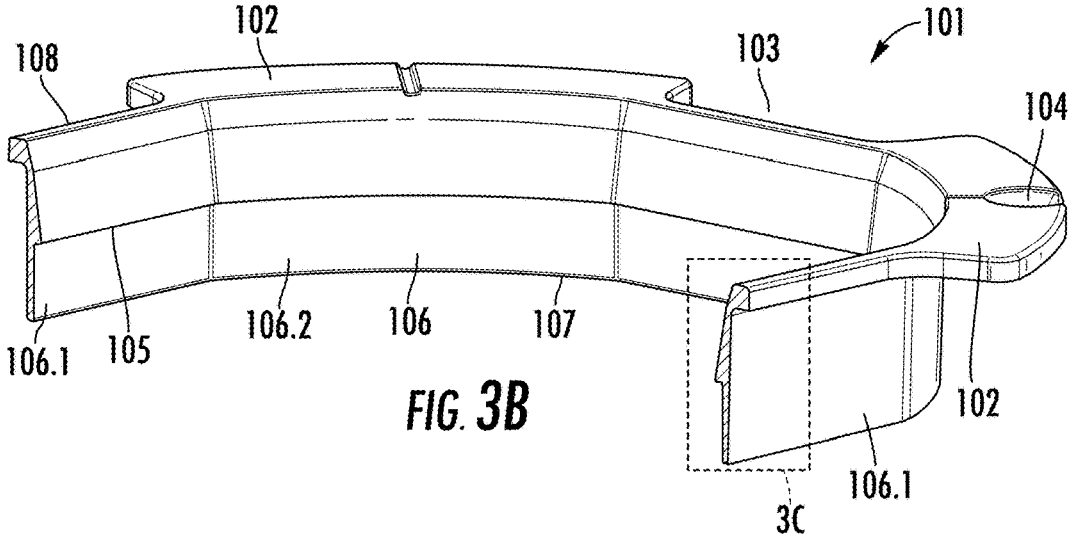
FIG. 3B is a cross-sectional view of the mounting bracket of FIG. 3A.
Figure 3C:
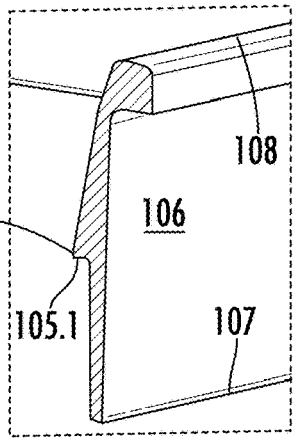
FIG. 3C is a detail view of area 3C of FIG. 3B.

The mounting bracket 101, in some embodiments, attaches directly to the junction box 151. For example, as shown in FIG. 1, the mounting bracket 101 may be attached to the junction box 151 using at least one fastener 11. As shown in FIGS. 3A and 3B, the mounting bracket 101 may include an axial portion 106 having at least one open end and a cross-section. In the illustrated embodiment, the cross-section is substantially annular, but it can be any shape to accommodate the shape and/or dimensions of the light fixture 121. The at least one open end may include a first end 107 (inserted into the junction box 151) and a second end 108 (adjacent to an opening of the junction box 151).

At least one flanged tab 102 extends outwardly from the axial portion 106. In cases where the mounting bracket 101 includes a plurality of flanged tabs 102, a gap 103 is formed between consecutive flanged tabs 102. Although the illustrated embodiments of the mounting bracket 101 includes four flanged tabs 102 and four gaps 103 between the tabs 102, the mounting bracket 101 may include any appropriate number of tabs 102 and gaps 103 (including fewer or more than four). At least one of the tabs 102 (two are illustrated) is arranged to align with mounting holes 152 of a typical junction box 151 where the holes are located at the corners of a junction box 151 having a square or rectangular cross-section. Each of the fastener(s) 11 may pass through a hole 104 located in one of the tabs 102 of the mounting bracket 101 (see FIGS. 3A and 3B). The hole(s) 104 may be countersunk or counterbored such that (when installed) the head of the fastener 11 is flush with (or recessed relative to) the surface of the mounting bracket 101 at the second end 108.

The annular cross-section of the axial portion 106 may have a circular shape. As shown in FIGS. 3A and 3B, in some embodiments, the axial portion 106 may include four approximately planar segments 106.1 (i.e., straight lines in the annular cross-section) corresponding to the locations of the four gaps 103. The planar segments 106.1 are connected to one another by curved segments 106.2, which correspond to the locations of the flanged tabs 102. The axial portion 106 is designed to interface with typical junction boxes (such as junction box 151 shown in FIGS. 1 and 2) such that the axial portion 106 is inserted into an opening of the junction box. In some embodiments, the distance between opposing planar segments 106.1 is approximately 4 inches (or any other appropriate dimension to interface with a junction box). Again, however, the above is merely a non-limiting example of a possible shape and size of a mounting bracket 101 contemplated herein. The mounting bracket 101 can have any geometry suitable for the purpose described herein.

The mounting bracket 101 may also include a lip 105 on the internal surface(s) of the mounting bracket 101 between the first end 107 and the second end 108. As shown in the cross-section shown in FIG. 3C, the lip 105 includes a protrusion extending toward a center of the mounting bracket 101. The thickness of the axial portion 106 increases gradually when moving from the second end 108 toward the lip 105, and there is a more immediate thickness change that occurs when moving from the lip 105 toward the first end 107 such that there is a ledge 105.1 formed at lip 105. The ledge 105.1 may be located at any distance from the first end 107 and second end 108, but in some embodiments is located approximately equidistant between the first and second ends 107, 108.

Figure 4A:
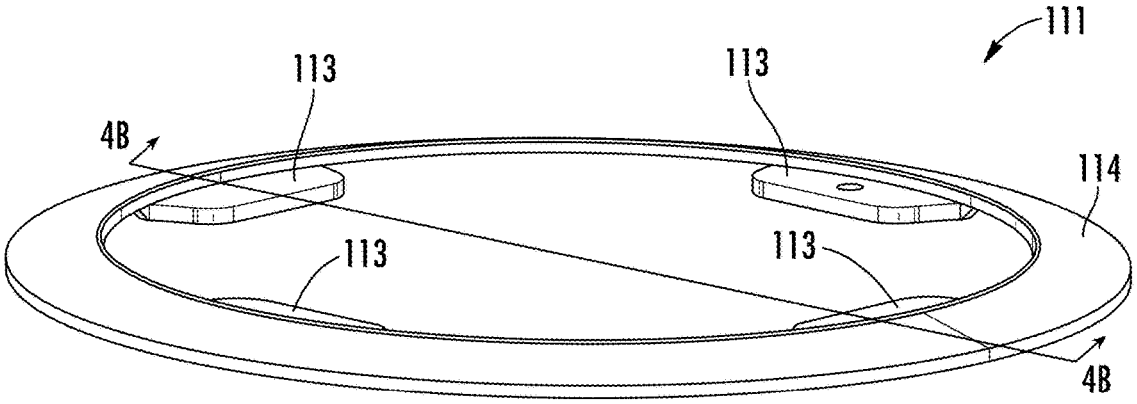
FIG. 4A is a perspective view of a trim ring of the lighting assembly of FIG. 1.
Figure 4B:
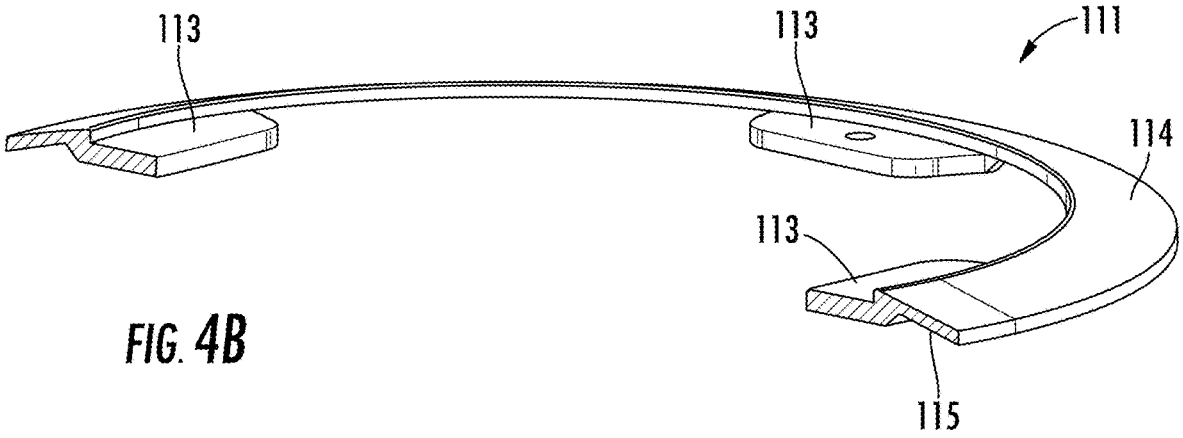
FIG. 4B is a cross-sectional view of the trim ring of FIG. 4A.

As shown in FIGS. 1, 2, 4A, and 4B, the trim flange ring 111 includes at least one inner tab 113, an outer surface 114, and an inner surface 115. As shown in FIGS. 2 and 6A, when the lighting assembly 100 is in the installed configuration, the outer surface 114 is exposed facing the architectural space and is located adjacent to external surface 124 of the light fixture 121 such that outer surface 114 and external surface 124 form an approximately continuous surface (and such that the outer surface 114 is a concentric ring around the external surface 124). The inner tab(s) 113 may correspond to the locations of the gap(s) 103 of the mounting bracket 101, the purpose of which is described below. As shown in FIGS. 4A, 4B, and 6A, the inner tab(s) 113 are vertically offset from the outer surface 114. In the installed configuration, the inner tab(s) 113 are approximately aligned with the flanged tab(s) 102 of the mounting bracket 101 and the inner tab(s) 113 interface with inner surface 123 of flange 122 of the light fixture 121 (see FIG. 6A). In other words, in the installed configuration, the flanged tab(s) 102 and the inner tab(s) 113 form an approximately continuous surface that interfaces with the inner surface 123 of flange 122 of the light fixture 121.

Figure 5A:
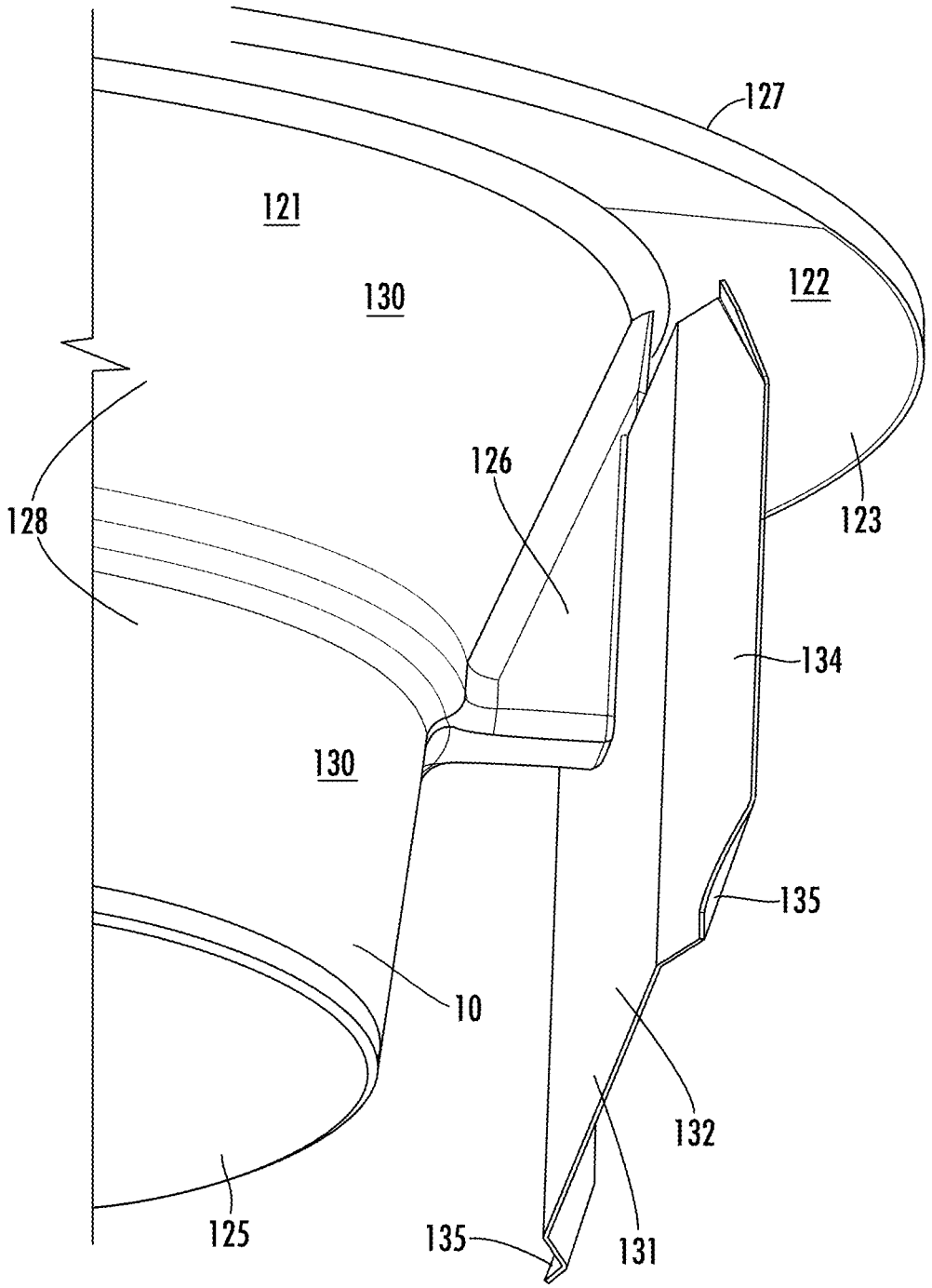
FIG. 5A is a partial perspective view of a light fixture and a spring clip of the lighting assembly of FIG. 1.
Figure 5B:
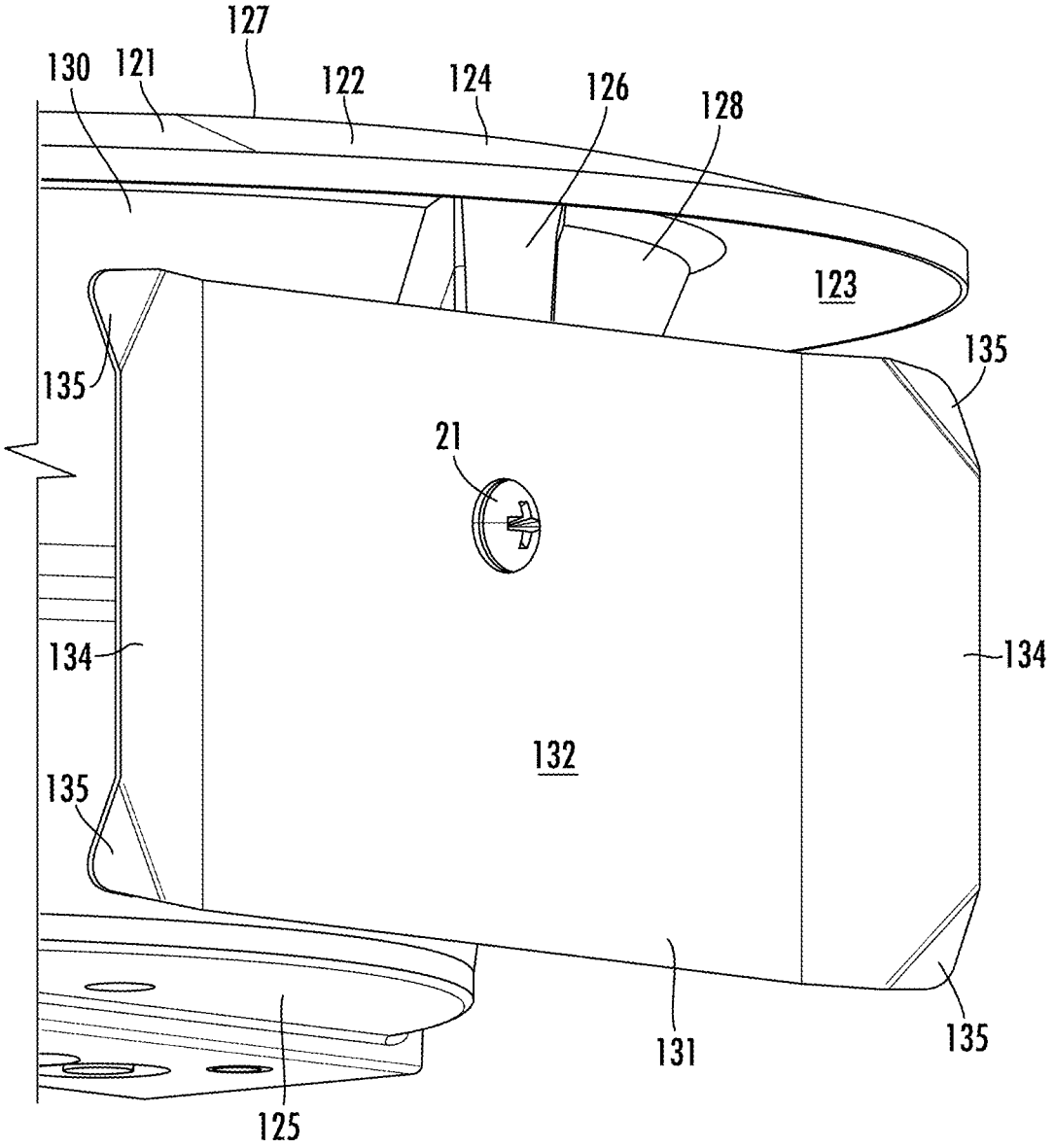
FIG. 5B is a perspective view of the spring clip of FIG. 5A.

To removably secure the light fixture 121 relative to the other components of the lighting assembly 100, at least one spring clip 131 is provided on the exterior wall 130 of the light fixture 121. In the illustrated embodiment, two spring clips 131 are provided on opposing sides of the body 23. However, other numbers and arrangements of the spring clips 121 are contemplated herein. The at least one spring clip 131 may be constructed from sheet metal, plastic, or any other appropriate material and may include at least one fold or bend to facilitate relative movement between the spring clip 131 and other components of the lighting assembly 100. In some embodiments, as shown in FIGS. 5A and 5B, the spring clip 131 is approximately rectangular and is attached to a protrusion 126 provided on the exterior wall 130 of the body 23 using a fastener 21 where the fastener 21 passes through a center section 132 of the spring clip 121 and is located approximately halfway between two end flaps 134 of the spring clip 121. The two end flaps 134 may be bent (in some but not all cases, permanently bent) relative to the center section 132 such that the end flaps 134 are bent outwardly from the body 23 (toward the mounting bracket 101 in the installed configuration). The bent configuration of the end flaps 134 ensures that the spring clip 131 must be deflected for the spring clip 131 to pass through the second end 108 of the mounting bracket 101, as described in more detail below. The spring clip 131 is shown in the resting (non-deflected) configuration in FIGS. 5A and 5B. To install the light fixture 121 such that the first end 125 passes through the second end 108 of the mounting bracket 101, the spring clip 131 must be deflected to more closely approximate the peripheral shape of the light fixture 121. The spring clip 131 is shown in the deflected configuration in FIG. 6A.

As shown in FIGS. 5A-6B, the at least one spring clip 131 may include at least one corner portion 135 that is bent (in some but not all cases, permanently bent) relative to the other portions of the spring clip 131 (including the center section 132 and the end flaps 134). In some embodiments, the corner portion(s) 135 are located at the outermost four corners of the spring clip 131 (i.e., at the two outermost corners of each of the end flaps 134). The corner portion(s) 135 may be bent toward the light fixture 121 (away from the mounting bracket 101 in the installed configuration) to ensure there are no protruding points that could engage or catch other components within the lighting assembly 100 which would inhibit movement of the light fixture 121 (either into or out of the junction box 151).

To install the lighting assembly 100 within the junction box 151, the first end 107 of the axial portion 106 of the mounting bracket 101 is inserted into the junction box 151 and fasteners 11 secure the mounting bracket 101 relative to the junction box 151. The trim flange ring 111 is provided on the light fixture 121. More specifically, the spring clips 131 are deflected inwardly to permit the trim flange ring 111 to slide over them such that the inner tabs 113 of the trim flange ring 111 abut the inner surface 123 of flange 122 to support the trim flange ring 111 on the light fixture 121. The light fixture 121 can then be brought in proximity with the junction box such that the appropriate electrical connections between the junction box and light fixture 121 can be made.

Figure 6B:
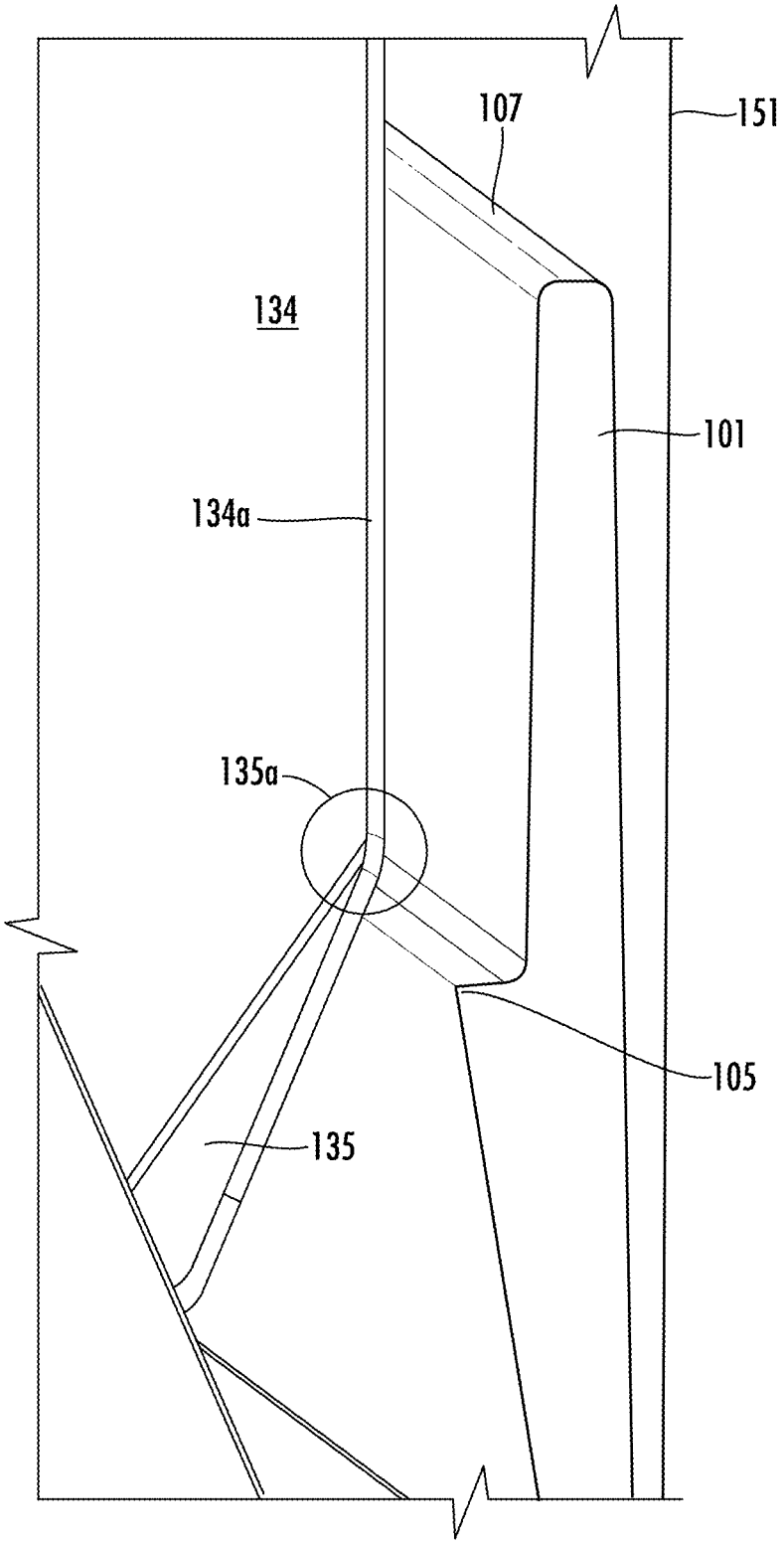
FIG. 6B is a detail view of area 6B of FIG. 6A.

To install the light fixture 121 into the junction box 151, the first end 125 of the light fixture 121 is inserted into the second end 108 of the mounting bracket 101. For this to occur, the light fixture 121 must be oriented such that the inner tab(s) 113 of the trim flange ring 111 (at this point supported on the light fixture 121) are aligned with the locations of the gap(s) 103 of the mounting bracket 101. When inserting the light fixture 121 into the mounting bracket 101, each spring clip 131 is deflected inwardly (see FIG. 6A) such that the outermost portions of the spring clip 131 slides across the ramped surface of the axial portion 106 (of the mounting bracket 101) between the second end 108 and the lip 105. As shown in FIGS. 6A and 6B, the light fixture 121 reaches a seated/engaged configuration (relative to the mounting bracket 101) when the two lower corner portions 135 (located closer to the second end 127 of the light fixture 121) engage the lip 105. In some embodiments, after the lateral edge 134*a* of the end flaps 134 slides along the lip 105, as shown in FIG. 6B, the lip 105 engages the spring clip 131 at the intersection of the corner portion 135 and the lateral edge 134*a*. In other words, the uppermost portion 135*a* of the corner portion 135 engages the lip 105 when the light fixture 121 is in the seated/engaged configuration relative to the mounting bracket 101. When the light fixture 121 is in the seated/engaged configuration, the inner surface 115 of the trim flange ring 111 may be in contact with a surface of a ceiling, wall, or floor panel. As shown in FIGS. 6A and 6B, in the seated/engaged configuration, the light fixture 121 passes through the entire length of the axial portion 106 such that a portion of the light fixture 121 extends through the second end 108 and beyond the first end 107 and further into the junction box 151.

In the seated/engaged configuration, the outer surface 114 (of the trim flange ring 111) and the external surface 124 (of the flange 122 of the light fixture 121) may form an approximately continuous surface (see FIG. 6A). To disengage the light fixture 121 from the mounting bracket 101, the light fixture 121 is pulled away from the mounting bracket 101 (e.g., by pulling flange 122 and/or trim flange ring 111) such that the spring clip(s) 131 disengage from lip 105 (e.g., moves downward past lip 105, as shown in FIG. 6B). After uppermost portion 135*a* moves beyond lip 105, the lateral edge 134*a* of the end flaps 134 slides along the lip 105 until the light fixture 121 is ready to be removed from the mounting bracket 101.

The components of the lighting assembly 100 may be formed of materials including, but not limited to, sheetmetal, galvanized steel, aluminum, carbon composite, plastic, thermoplastic, stainless steel, other metallic materials, other composite materials, or other similar materials. Moreover, the components of the lighting assembly 100 may be attached to one another via suitable fasteners, which include, but are not limited to, screws, bolts, rivets or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A lighting assembly for illuminating an architectural space, the lighting assembly comprising:

a mounting bracket comprising an axial portion, the axial portion comprising:
an annular cross-section,
four flanged tabs, and
at least one open end;

a trim flange ring comprising an outer surface and four inner tabs; and a light fixture comprising a flange with an external surface;

and wherein:

at least a portion of the light fixture is capable of placement inside the axial portion;

the trim flange ring is capable of placement between the mounting bracket and the light fixture;

the four flanged tabs and the four inner tabs are capable of being aligned to form an approximately continuous flange behind the flange of the light fixture; and the outer surface is capable of placement facing the architectural space such that the outer surface is a concentric ring around the external surface of the flange of the light fixture.

2. The lighting assembly of claim 1, wherein:

the mounting bracket is is capable of attachment to a junction box such that when thus attached, at least a portion of the light fixture is disposed inside the junction box.

3. The lighting assembly of claim 2, wherein:

the mounting bracket comprises at least one flanged tab;

the lighting assembly further comprises at least one fastener that is capable of passing through the at least one flanged tab to attach the mounting bracket to the junction box; and at least a majority of the axial portion is capable of placement within the junction box such that the at least one open end is approximately aligned with an opening of the junction box.

4. The lighting assembly of claim 1, wherein the outer surface of the trim flange ring and the external surface of the flange of the light fixture form an approximately continuous surface facing the architectural space, and wherein the flange of the light fixture comprises an approximately circular cross-section.

5. The lighting assembly of claim 1, wherein the axial portion of the mounting bracket comprises at least two planar segments and at least two curved segments.

6. The lighting assembly of claim 1, wherein the light fixture comprises at least one spring clip and the at least one spring clip comprises at least two permanently bent portions.

7. The lighting assembly of claim 6, wherein the at least one spring clip comprises a center section and at least one end flap that is permanently bent relative to the center section.

8. The lighting assembly of claim 6, wherein the at least one spring clip comprises at least one corner portion that is permanently bent relative to other portions of the spring clip.

9. A lighting assembly for illuminating an architectural space, the lighting assembly comprising:

a mounting bracket comprising an axial portion, the axial portion comprising an annular cross-section and at least one open end;

a trim flange ring comprising an outer surface;

a light fixture comprising:

a flange with an external surface, at least one spring clip that has:

at least two permanently bent portions, and at least one corner portion that is permanently bent relative to other portions of the spring clip;

and wherein:

at least a portion of the light fixture is capable of placement inside the axial portion;

the trim flange ring is capable of placement between the mounting bracket and the light fixture:

the outer surface is capable of placement facing the architectural space such that the outer surface is a concentric ring around the external surface of the flange of the light fixture; and a lip on an interior surface of the axial portion of the mounting bracket is capable of engaging an intersection of (i) the at least one corner portion and (ii) an edge of the at least one spring clip.

10. A lighting assembly for illuminating an architectural space, the lighting assembly comprising:

a mounting bracket comprising,
an axial portion,
four flanged tabs, and
at least one open end;

a trim flange ring comprising an outer surface and four inner tabs;

a light fixture;

and wherein:

at least a portion of the light fixture is capable of placement inside the axial portion; and at least a majority of the axial portion is capable of placement inside a junction box;

the trim flange ring is capable of being positioned between the mounting bracket and the light fixture;

a light source of the light fixture is capable of being entirely disposed inside the junction box; and the four flanged tabs and the four inner tabs are capable of being aligned to form an approximately continuous flange behind the light fixture.

11. The lighting assembly of claim 10, wherein:

at least one of the four flanged tabs is capable of receiving at least one fastener therethrough to attach the mounting bracket to the junction box; and the at least one open end is capable of being approximately aligned with an opening of the junction box.

12. The lighting assembly of claim 10, wherein the outer surface of the trim flange ring and an external surface of a flange of the light fixture are capable of forming an approximately continuous surface facing the architectural space.

13. The lighting assembly of claim 10, wherein the axial portion of the mounting bracket comprises at least two planar segments and at least two curved segments.

* * * * *